US005256122A

United States Patent [19]

Deden

[11] Patent Number: 5,256,122

[45] Date of Patent: Oct. 26, 1993

[54] RESISTANCE ENGAGEMENT SYSTEM

[76] Inventor: Michael J. Deden, 1530 Maurice Ave., Missoula, Mont. 59801

[21] Appl. No.: 873,698

[22] Filed: Apr. 22, 1992

Related U.S. Application Data

[63] Continuation-in-part of Ser. No. 754,216, Aug. 27, 1991, abandoned, which is a continuation-in-part of Ser. No. 553,971, Jul. 17, 1990, abandoned.

[51] Int. Cl.[5] ..... A63B 21/062

[52] U.S. Cl. ..... 482/99

[58] Field of Search ..... 482/99-103, 482/133-138

[56] References Cited

U.S. PATENT DOCUMENTS

| | | | |
|---|---|---|---|
| 372,272 | 10/1887 | Murphy | 272/118 |
| 3,559,987 | 2/1971 | Pear | 272/118 |
| 4,111,414 | 9/1978 | Roberts | 272/118 X |
| 4,358,107 | 11/1982 | Nissen | 272/118 |
| 4,493,485 | 1/1985 | Jones | 272/134 X |
| 4,603,855 | 8/1986 | Sebelle | 272/117 |
| 4,709,920 | 12/1987 | Schnell | 272/117 |
| 4,721,301 | 1/1988 | Drake | 272/118 |
| 4,809,973 | 3/1989 | Johns | 272/118 |

FOREIGN PATENT DOCUMENTS

| | | | |
|---|---|---|---|
| 240087 | 10/1987 | European Pat. Off. | 482/99 |
| 687153 | 2/1953 | United Kingdom | 272/118 |

OTHER PUBLICATIONS

CYBEX Brochure, 1989.

*Primary Examiner*—Robert Bahr

[57] ABSTRACT

The disclosed invention relates to the integration of a resistance selection of selectorized weight stacks with a range of motion (ROM) selection of ROM elements adapted to engage a user and transmit a lifting force to an in-line selectorized weight stack. It involves replacing the weight selector rod of prior selectorized weight stacks with a flexible connector (FC). The FC operates in-line to respective ROM elements and is guided from below a selectorized weight stack and above, at a particular weight stack travel, for vertical oscillatory movement through a vertical opening extending through the central portion of a weight stack. An engaging member is provided to engage a selected weight plate at a selected point along a FC's length, whereby, providing an integrated range of motion selection of FC in-line ROM elements with a resistance selection.

24 Claims, 8 Drawing Sheets

RESISTANCE ENGAGEMENT SYSTEM

This application is a continuation-in-part of application Ser. No. 07/754,216, filed Aug. 27, 1991, now abandoned, which is turn is a continuation-in-part of application Ser. No. 07/553,971, filed Jul. 17, 1990, now abandoned.

TECHNICAL FIELD

The present invention relates to exercise devices that provide a range of motion selection of those user engageable elements adapted to transmit a lifting force to an in-line selectorized weight stack.

BACKGROUND OF THE INVENTION

Predominantly, exercise apparatuses that utilize selectorized weight stacks as a source of resistance, also incorporate some type of range-limiting device. These devices usually allow a user to select a desired starting point and stopping point along a particular range of motion (ROM). Furthermore, they play a significant role in medical rehabilitation programs where ROM variables such as a users' injury, flexibility, size or desired exercise must be accommodated.

Generally, range-limiting devices operate in-line to selectorized weight stacks and require an additional step in machine set-up. These devices are often times elaborate, unreliable and expensive. U.S. Pat. No. 4,603,855 discloses a variable exercise apparatus incorporating a range-limiting device that provides selective positioning of a cable attached handle along a ROM. This device takes-up and pays-out cable from a drum to the attached handle and is selectively engageable by a clutching means to an additional drum and cable system that operates the selectorized weight stack. To operate, a user first engages a selected resistance level and then engages the clutching device at a selected handle position.

Many strength system manufacturers produce range-limiting devices that operate in-line to their selectorized weight stacks. These devices provide selective start and stop positioning of those user engageable elements or ROM elements adapted to transmit a lifting force to an in-line selectorized weight stack. To operate, a user or physical therapist must first select a desired resistance level and then make a ROM selection. ROM selection includes a starting and stopping point selection. Starting point selection is achieved via a free wheeling ROM element acting about an axle attached cam that is selectively engageable at 10 degree increments to the axle by an engaging pin means; and a stopping point selection, via an axle stop device that is selectively engageable at 10 degree increments by an additional engaging pin means, and prevents further axle rotation. Therefore, a ROM selection involves a cumbersome task of releasing and engaging a pair of engaging pins while positioning ROM elements to a desired starting position. Another inherent drawback to this type of range-limiting device, involves a cam that disengages with a ROM selection, resulting in an incorrect biomechanical variable resistance throughout a selected ROM.

BRIEF DESCRIPTION OF INVENTION

With the foregoing in mind, it is an object of the present invention to provide a multiple functioning resistance engagement system that integrates resistance selection of selectorized weight stacks with a ROM (range of motion) selection. Though selectorized weight stacks provide a superior source of variable resistance for present day strength systems, their potential as a range-limiting device has yet to be recognized. To recognize this potential, the in-line relationship between the resistance engagement of selectorized weight stacks and ROM elements such as handles and other user engaging elements adapted to transmit a lifting force to an in-line selectorized weight stack, must be considered. This in-line relationship is the key in integrating resistance selection with ROM selection. Subsequently, since a source of resistance and its level selection must exist, the only area of selection integration must occur at the engagement location of a selected resistance level (i.e. at a selected weight plate).

To accomplish the above task, the present invention incorporates a Variable Point Resistance system (VPR system). The VPR system provides a guide means to guide an engageable member for a line of guide of vertical oscillatory movement through a vertical opening extending through the central portion of a selectorized weight stack. These guide means are positioned below the stack and above at a particular weight stack travel. Furthermore, the engageable member is adapted to receive a user imparted lifting force from respective ROM elements. Lastly, the VPR system incorporates an engaging means to selectively engage the engageable member at a selected point along its length to a selected weight plate. Therefore, the engageable member oscillates back and forth with respective ROM elements until a desired range of motion is determined; at which point a user simply engages a selected weight plate at a selected point along the engageable member's length and exercise may begin. It is recommended to provide sufficient engageable member length (guided from below the weight stack) as to allow selective ROM engagement with the entire stack throughout a machine's full range of motion. A basic rule to provide sufficient length guided past the stack's bottom, would be a length equal to a respective weight stack travel.

It is clear to one skilled in the art that a solid engageable member would require an unfavorable increase in a weight stack's height, by accommodating for the member's length extending past the bottom of the stack. Subsequently, to prevent this unfavorable result, it is preferred to utilize the character of Flexible Connectors (FC's) as the engageable member, and guide them to existing machine areas. FC's include elements such as chain, webbing, cable and rope, and provide three vital functions. First, a connector provides a means for force transmission. Secondly, a flexible connector allows force transmission to occur to or from any location by guide means commonly used in the industry (i.e. pulleys, etc.). Thirdly, all FC's are engageable along their length with a suitable engagement means such as engaging pins, ratcheting mechanisms, frictional camming devices, and others. The drive chain industry provides perhaps the best example of FC's; although all FC's are engageable along their length, by some means, they generally employ a less desirable and less dependable engagement means.

The VPR system of the present disclosed invention utilizes two types of FC engagement. First, a bi-directional engagement means, that provides a bi-directional engagement of a selected point along a FC and a selected weight plate. Secondly, a progressive range engagement means, that allows a user to automatically progress from an initial selected starting point, into greater ranges of motion at the same selected resistance level. Progressive range engagement is accomplished by an engaging means that engages a selected weight plate to a selected point along the FC solely when FC is drawn in weight stack travel. FC drawn other than weight stack travel is allowed to pass by the progressive range engagement means, without being engaged, whereby providing progression into greater ranges of motion.

The design of these engagement means is largely determined by the character of the FC. For example, to engage a FC such as webbing, a frictional camming device incorporated within each weight plate may be needed. This system could facilitate infinite points of progressive range engagement along the webbing, providing, that a selected or activated weight plate engages the FC solely when it is drawn in weight stack travel, and releases it while the selected engaged weight plate is at rest and FC is drawn back into the stack. Although this system could be implemented, its cost and foreseeable unreliability could prevent it from entering the market place.

To properly design a superior VPR system, factors such as user friendliness, reliability and cost must be carefully considered. The preferred VPR system includes a bi-directional and progressive range engagement option by simply incorporating two interchangeable, yet separately functioning weight support pins. A preferred FC includes a rollerless hoist chain chosen for its inherent strength, durability, and incremented points of engagement. The rollerless hoist chain is guided from below the stack and from above at a particular.weight stack travel, for a line guide of vertical oscillatory movement through a vertical opening extending through the central portion of a weight stack. Furthermore, after being engaged with a selected weight plate, the above weight support pins are adapted to automatically engage a misaligned selected point of FC incremented engagement; a user friendly feature that eliminates the burden (during pin engagement) of positioning ROM elements to an exact position of FC incremented engagement. Automatic FC engagement is achieved by virtue of a misaligned weight support pin creates an offset in a FC's line of guide, up until respective ROM elements are moved about a selected starting point, and a selected point of FC incremented engagement is properly aligned to return to its line of guide and engage a selected pin.

By guiding a FC through selectorized weight stacks in place of the weight selector rod of prior art, the VPR equipped selectorized weight stack of the present invention becomes a multiple functioning resistance engagement system. From an engineering standpoint, the preferred VPR system is an extremely simple, cost effective, and versatile design that is destined to produce a new generation of strength systems. From a user standpoint, the preferred VPR system offers an unsurpassed option to automatically progress from an initial selected starting point into greater ranges of motion at the same selected resistance level. Furthermore, by guiding excess FC to existing machine areas, the present invention provides a range greater than a given weight stack travel, in which that weight stack travel can be utilized without adding machine size or total weight stack complex height. In addition, closed or open VPR circuits are easily designed through VPR equipped weight stacks and can incorporate a wide variety of in-line elements that will perform tasks limited only to an engineer's imagination. These circuits will also provide the strength system industry with two fundamental drive systems that may render prior range-limiting devices obsolete.

The VPR system of the present invention is not only limited to manual operation (i.e. inserting engaging pins, or activating a selected resistance level via push-pull cables), but it is easily conceived that a series of similar engagement means electronically operated (i.e. solenoids, etc.) could be incorporated within each plate. These electronic means could be activated by switches attached preferably to respective ROM elements and include a plus or minus resistance level selection switch and an engage-disengage ROM selection switch.

Further VPR design considerations include a user accessible weight stack and a proper user-tuned weight stack as to prevent residual engaged weight plate inertia from producing an inconsistent resistance or possibly FC disengagement during weight stack travel with either a bi-directionally engaged or a progressive range engaged selected weight plate. Although a proper user-tuned weight stack can prevent residual inertia, there are instances where it is likely to occur, and include the following. A misuse, whereby a user ballistically accelerates the engaged weight plates and then immediately retracts respective ROM elements and residual engaged weight plate inertia remains. A ROM selection stop abatement where residual engaged weight plate inertia remains after abatement. And a FC end of draw stop abatement where residual engaged weight plate inertia remains after abatement.

Besides producing an inconsistent resistance, residual engaged weight plate inertia may further cause an unfavorable FC disengagement during weight stack travel predominantly with a progressive range engagement means and less likely with a bi-directional engagement means exhibiting automatic FC engagement. This may result in damage from falling weight plates or "Float Engagement", where after FC disengagement, a respective engagement means may reengage on its respective upward or downward travel along the FC and possibly cause injury to a user from resultant inconsistent resistance.

There are an endless number of means to eliminate FC disengagement during weight stack travel. First and perhaps the simplest means is to initially engage a selected weight plate to the FC by a means that eliminates FC disengagement prior to and during weight stack travel. Though this means would eliminate FC disengagement during weight stack travel, it would also eliminate the benefits prior to weight stack travel of Progressive range engagement and bi-directional engagement exhibiting automatic FC engagement. To receive these benefits and the simplicity to which they are achieved, the elimination of FC disengagement during weight stack travel must be examined further.

Since progressive range engagement and automatic FC engagement both involve a period of FC disengagement the means of eliminating FC disengagement during weight stack travel must allow FC disengagement to occur only prior to weight stack travel. With this in mind, an appropriate means to eliminate FC disengagement during weight stack travel can be formulated. Initially one might integrate a mechanism into each weight plate that is adapted to close an avenue of FC disengagement (i.e. FC's line of guide offset) during weight stack travel and open this avenue of FC disengagement when the engaged weight plate comes to rest on the remaining stack or stack supporting frame. Although this means could be implemented, its foreseeable cost would likely prevent it.

Other means may operate off the principle that the top weight plate is always lifted in weight stack travel with any selected resistance level. Therefore the top weight plate could activate a means to eliminate FC disengagement only when a selected resistance level is lifted in weight stack travel. These means may include a FC locking mechanism (i.e. frictional cams, pins, etc.) integrated within the top plate, that is activated by a trip when it is lifted from its resting position in weight stack travel and is disengaged by the trip when it comes back to rest. Although this means could be implemented, the fact that the FC locking mechanism must be of substantial design to withstand the residual inertia of an entire selected resistance level during a FC end of draw stop abatement, may prove to costly to manufacture and or maintain.

The preferred means of the disclosed invention operates off the principle of eliminating FC disengagement only at the selected engaged weight plate, whereby having to abate the residual inertia of a single weight plate during a FC end of draw stop abatement or other similar instances. Essentially, the preferred means comprises of a rotating rod adapted to open an avenue of FC disengagement (i.e. FC's line of guide offset) only when the top weight plate is in a resting position and close the avenue of FC disengagement when it is lifted in weight stack travel. The rod extends the length of the weight stack and weight stack travel, and is mounted in the FC's avenue of disengagement from above and below this region by rotational mounting means that provide rotation to occur thru the rod's length. Along the rod's length there is a recessed region extending the length of the weight stack, that provides an open avenue of FC disengagement only when the top weight plate is in a resting position. A rotator pin is further integrated within the top weight plate and is adapted to be received by a helical groove integrated along the rods length as to rotate the rod ninety degrees when the top weight plate is lifted in weight stack travel. Preferably, the ninety degree rotation is appropriately designed to occur in a minimum amount of weight stack travel while maintaining smooth operation. Initially when the top weight plate is in its resting position, the rod's recessed region provides an open avenue of FC disengagement. When the top weight plate is lifted in weight stack travel the rotator pin rotates the rod's ninety degrees via the helical groove so that the rod's full profile closes the avenue of FC disengagement. As the top weight plate returns to its resting position the rotator pin rotates the rod back ninety degrees so that the rod's recessed region reopens the avenue of FC disengagement.

Although FC disengagement during weight stack travel is an important consideration in implementing VPR systems that provide progressive range engagement and bi-directional engagement exhibiting automatic FC engagement, there are instances in which FC disengagement during weight stack travel is unlikely to occur due to the near elimination of residual inertia and or resultant FC slack. One such case is a bi-directionally engaged closed VPR circuit where FC slack is engineered not to exist. Another such case is where weight packs are implemented and resistance levels are changed by changing the distance a weight pack is lifted thru a particular ROM, opposed to changing the amount of weight lifted as with selectorized weight stacks. Weight packs can cut residual inertia to an absolute minimum and therefore possibly receive the benefits of progressive range engagement and Bi-directional engagement exhibiting automatic FC engagement without incorporating a safeguard means of eliminating FC disengagement during weight pack travel.

Furthermore, it is to be understood that the above means of eliminating FC disengagement during weight stack travel are rarely fully activated in a properly tuned weight stack environment except in cases of misuse. These, and still further objects and advantages will become apparent upon reading the following detailed description, which taken with the accompanying drawings disclose a preferred form of the disclosed invention.

BRIEF DESCRIPTION OF THE DRAWINGS

A preferred embodiment of the present invention is illustrated in the accompanying drawings, in which.

DETAILED DESCRIPTION OF THE PREFERRED EMBODIMENT

This continuation-in-part application includes additional information concerning a means for eliminating FC disengagement during weight stack travel resulting from residual engaged weight plate inertia, which was generally discussed in the parent application as an anti-float mechanism.

While the present invention will be described more fully hereinafter with reference to the accompanying drawings, in which a preferred embodiment of the present invention is shown, it is to be understood that those skilled in the appropriate arts may modify the present disclosed invention while still achieving the favorable results of this invention.

Figure 1:
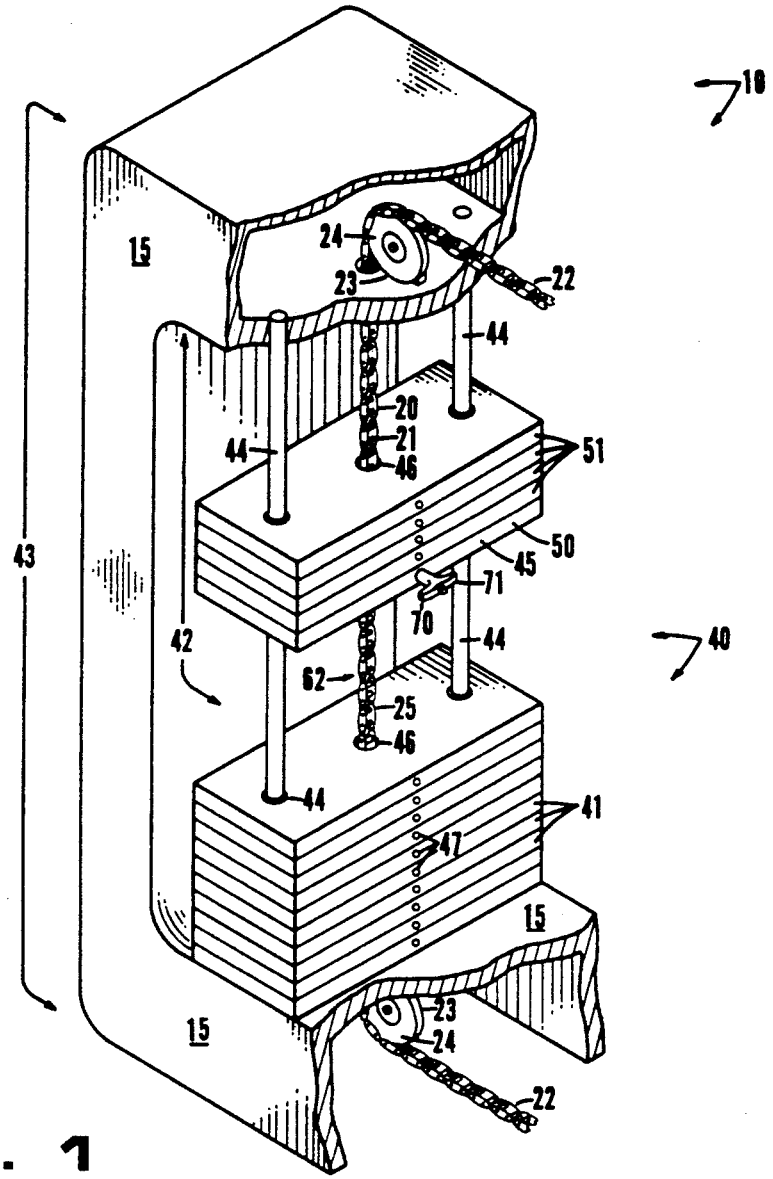
FIG. 1 is an isometric view of the preferred form of a VPR equipped selectorized weight stack of the present invention.
Figure 2:
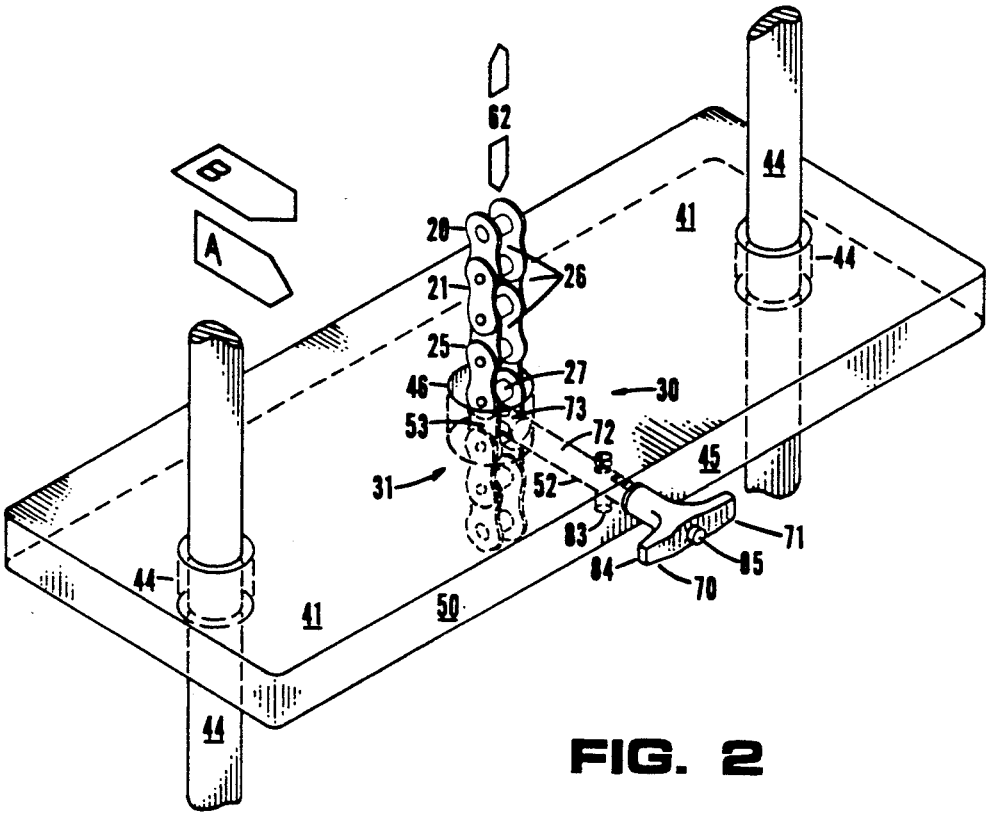
FIG. 2 is an enlarged isometric view of the selected FC engaged weight plate in FIG. 1 exemplifying a preferred means of engagement in phantom lines.
Figure 3:
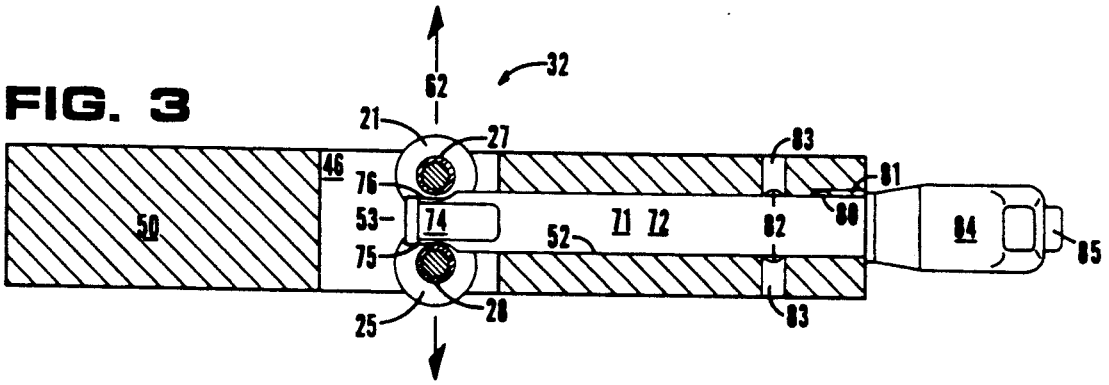
FIG. 3 is an enlarged vertical sectional view taken through plane A in FIG. 2 exemplifying a preferred means of bi-directional engagement.
Figure 4:
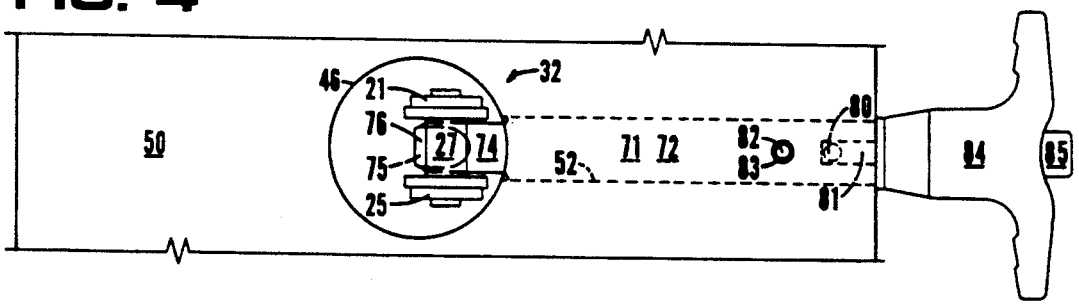
FIG. 4 is an enlarged top view taken below plane B in FIG. 2 exemplifying FIG. 3's preferred means of bi-directional engagement.
Figure 5:
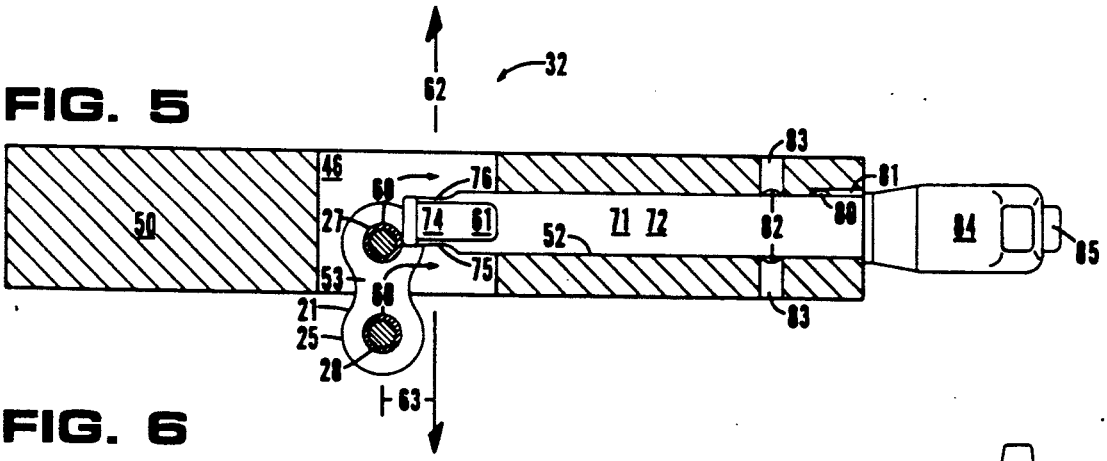
FIG. 5 is an enlarged vertical sectional view taken through plane A in FIG. 2 exemplifying a FC line of guide offset created by a misaligned bi-directional engagement pin of FIG. 3.
Figure 6:
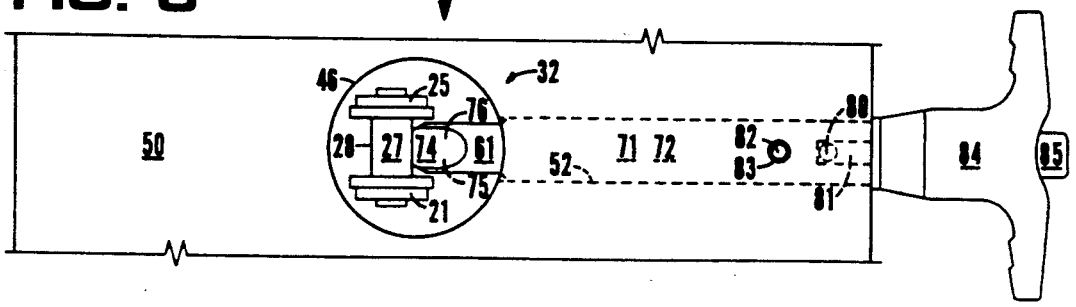
FIG. 6 is an enlarged top view taken below plane B in FIG. 2 exemplifying a FC line of guide offset created by a misaligned bi-directional engagement pin of FIG. 3.
Figure 7:
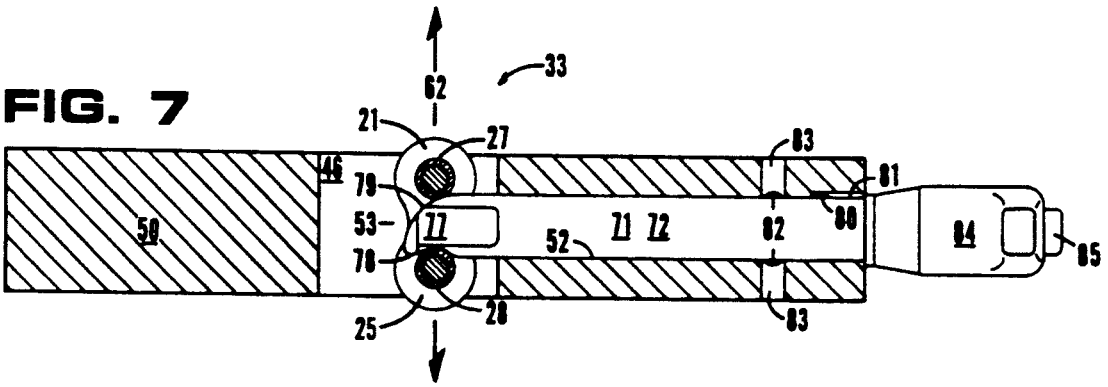
FIG. 7 is an enlarged vertical sectional view taken through plane A in FIG. 2 exemplifying a preferred means of progressive range engagement.
Figure 8:
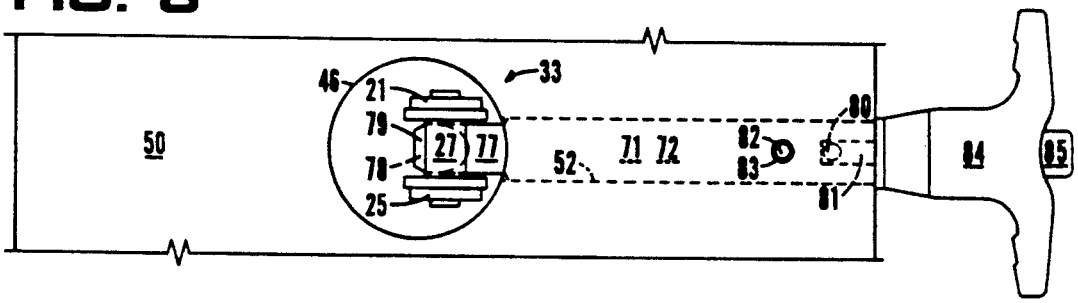
FIG. 8 is an enlarged top view taken below plane B in FIG. 2 exemplifying FIG. 7's preferred means of progressive range engagement.
Figure 9:
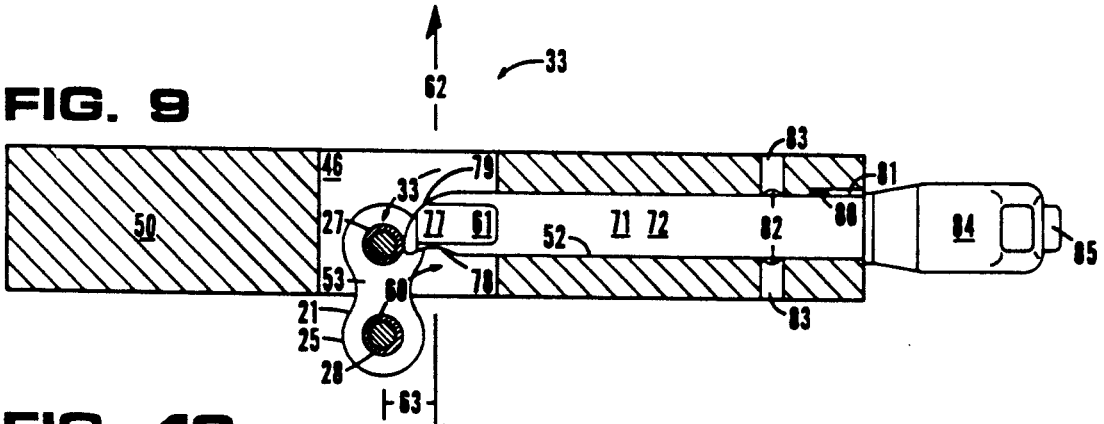
FIG. 9 is an enlarged vertical sectional view taken through plane A in FIG. 2 exemplifying a FC line of guide offset created by either progressive range engagement occurring, or a misaligned progressive range engagement pin of FIG. 7.
Figure 10:
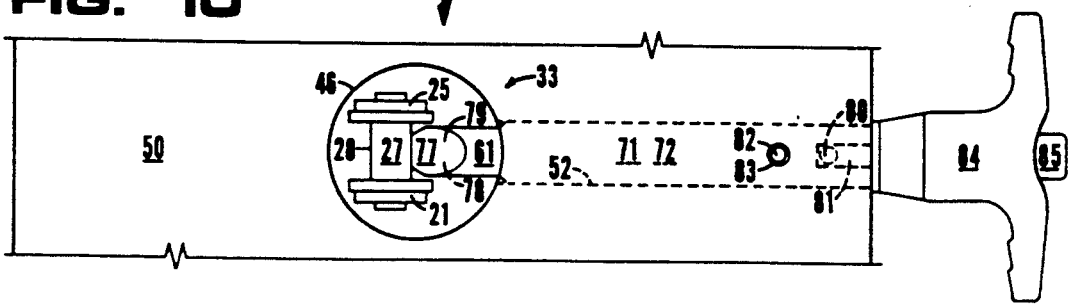
FIG. 10 is an enlarged top view taken below plane B in FIG. 2 exemplifying a FC line of guide offset created by either progressive range engagement occurring, or a misaligned progressive range engagement pin of FIG. 7.
Figure 11:
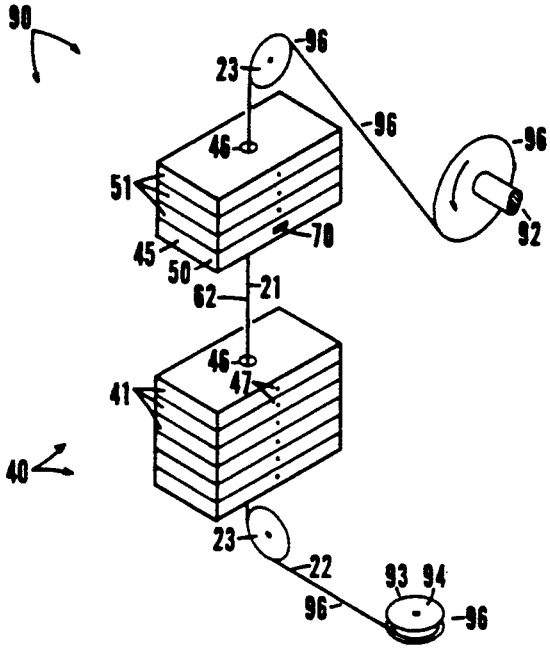
FIG. 11 is a schematic isometric drawing exemplifying an open VPR circuit incorporated within a fundamental VPR drive system.
Figure 12:
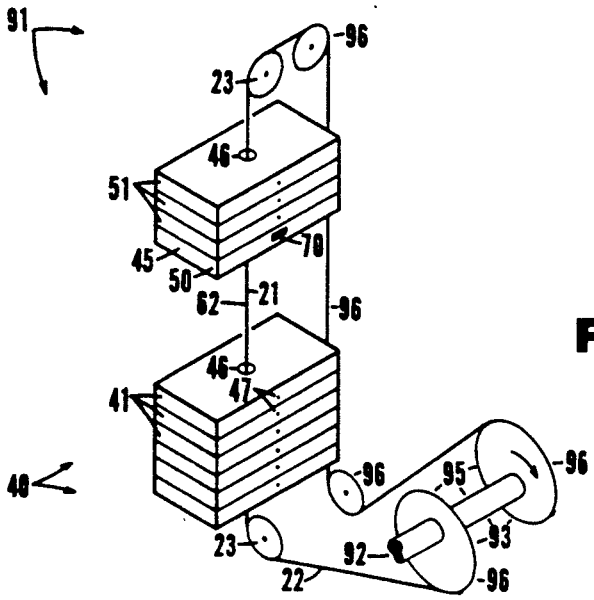
FIG. 12 is a schematic isometric drawing exemplifying a closed VPR circuit incorporated within a fundamental VPR,drive system.

A VPR equipped selectorized weight stack exemplifying preferred features of the present invention is shown alone in FIG. 1 and generally identified in the drawings by the reference numeral 10. FIG. 2 exemplifies a preferred means of engaging 31 a selected weight plate 50 to an engageable member 20, illustrated as a FC 21, FIGS. 3–6 exemplify a preferred means of bi-directional FC engagement 32. FIGS. 7–10 exemplify a preferred means of progressive range engagement 33. For purposes of gaining a more complete understanding of the invention's utility, FIG. 11 and 12 schematically show two fundamental VPR drive systems incorporating an open 90 (FIG. 11) and a closed 91 (FIG. 12) VPR circuit. FIGS. 13–16 exemplify a preferred means of eliminating FC disengagement during weight travel and facilitating progressive range engagement and bi-directional engagement exhibiting automatic FC engagement prior to weight stack travel.

The VPR equipped selectorized weight stack 10 of the present invention includes the following preferred constituents: a frame means 15 to support those means that achieve the results of the invention; a vertically stacked array of individual engageable weight plates 40 guided by a guide means 44 for vertical oscillatory movement in an above weight stack travel 42; an engageable member 20 (preferably a FC 21) guided by a guide means 23 (positioned above the weight stack travel 42 and below the weight stack 40) for a line of guide 62 of vertical oscillatory movement about the weight stack 40; an engaging means 30 for engaging a selected weight plate 50 at a selected point 53 along the preferred FC's 21 length; a ROM element means (attachable at drive points 92 exemplified in FIGS. 11 and 12) adapted to engage a user, and transmit a lifting force to a FC engaged weight plate 50; and a carriage means 45 provided by the FC engaged weight plate 50 to support selected overlying weight plates 51 for a carriage travel (i.e. weight stack travel 42). To operate the above preferred VPR constituents, a user first positions respective ROM elements to a desired range of motion, and then simply engages a selected Weight plate 50 to the preferred FC 21 via the engaging means 30, and exercise may begin.

The preferred VPR engagement means 31 are exemplified in FIGS. 2–10 and include the following means: a FC 21, illustrated as a rollerless hoist chain 25, providing points of incremented engagement 26 along its length; each point of engagement 26 having an upper stop 27 and lower stop 28; a pair of roller guides 24 for guiding the rollerless hoist chain 25 for a line of guide 62 of vertical oscillatory movement through a vertical opening 46 extending through the central portion of the weight stack 40; a central horizontal way 47 intersecting the central vertical opening 46 of each weight plate 41; and an engaging element means 70 adapted to engage a selected horizontal way 52 and further provide an automatic FC engagement means 60 for engaging a selected point 53 of FC incremented engagement 26. Automatic FC engagement 60 is achieved by virtue of a misaligned engaging element means 61 creates an offset 63 in the FC's line of guide 62, up until respective FC in-line ROM elements are moved about a selected starting point, and a selected point 53 of FC incremented engagement 26 is properly aligned to return to its line of guide 62 and engage the engaging element means 70. Therefore, eliminating the burden of aligning a selected point 53 of FC incremented engagement 26 (via, back and forth movement of respective ROM elements) with the engaging element means 70 during its engagement with a selected weight plate 50, and allowing a user to simply engage a selected weight plate 50 at a selected ROM element starting point, and begin exercising.

The above engaging element means 70 preferably includes two separately functioning, yet interchangeable weight support pins, illustrated as quick release pins 71, each of which include the following preferred features: a shank 72 (supported by a handle 84) for engaging a selected horizontal way 52; a FC engaging tip 73 (supported by the shank's 72 end) for extending into the FC's line of guide 62 and provide the above automatic FC engaging means 60 with a selected point 53 of FC incremented engagement 26, and having sufficient strength to support a respective weight stack 40; a pair of quick release retention balls 82 (supported by the shank 72 and operable by a handle 84 supported button 85) for engaging a retention ball way 83 in a selected weight plate 50; and an orientation guide ball 80 (supported by the shank 72) to engage an orientation guide 81 in a selected weight plate 50, for the proper orientation of the FC engaging tip 73. To operate, the shank 72 supported engaging tip 73 is first inserted into a selected horizontal way 52 (at a selected ROM element starting point), up until, the retention balls 82 come in contact with the selected horizontal way 52. Then the handle 84 supported button 85 is depressed and thereafter released, as to release the retention balls 82 and allow the engaging tip 73 to be further inserted into the selected horizontal way 52. Subsequently, the orientation guide ball 80 is properly aligned to fully engage the orientation guide 81 of the selected weight plate 50, and allow the retention balls 82 to engage the retention ball way 83. At this point, the quick release pin 71 is fully engaged and exercise may begin at the selected ROM element starting point. To remove, the handle 84 supported button 85 is depressed and the quick release pin 71 can be pulled out of the selected horizontal way 52 while the selected weight plate 50 is at rest on the remaining unengaged stack 40, or stack supporting frame 15.

The above FC engaging tip 73 is furnished in two preferred designs. First, a bi-directional engagement tip 74 (exemplified in FIGS. 3–6) providing the above automatic FC engagement means 60 with a selected point 53 of FC incremented engagement 26. The bi-directional engagement tip includes a lower engaging surface 75 and an upper engaging surface 76 for engaging respective stops 27 and 28, for a bi-directional engagement 32 with a selected point 53 of FC incremented engagement 26. Secondly, a progressive range engagement tip 77 (exemplified in FIGS. 7–10) providing the above automatic FC engagement means 60 with a selected point 53 of FC incremented engagement 26. The progressive range engagement tip 77 includes a lower engaging surface 78 for engaging a selected lower stop 27 during a FC weight stack travel, and a passive upper surface 79, for allowing selected upper stops 27 to pass by without being engaged in a respective downward direction for progressive range engagement 33 with selected points 53 of FC incremented engagement 26. Progressive range engagement 33 allows a user to automatically progress from an initial selected ROM element starting point into greater ranges of motion at the same selected resistance level; a user friendly feature that will revolutionize the strength system industry. Progressive range engagement 33 will also allow a user to automatically warm up into greater ranges of motion at the same selected resistance level. In addition, progressive range engagement 33 will ease a user's entry and exit of strength systems, by virtue of free wheeling ROM elements accommodating for ROM variables such as a user's injury, flexibility, and size.

For the purposes of gaining a complete insight to the utility of the present disclosed invention, FIGS. 11 and 12 exemplify two fundamental VPR drive systems that include an open 90 (FIG. 11) and a closed 91 (FIG. 12) VPR circuit. These circuits include the following: a VPR equipped selectorized weight stack 10; a variety of VPR in-line drive elements 96 including pulleys, cable assemblies, and cams; a ROM element(s) attachable at drive points 92 to engage a user and transmit a lifting force to selected VPR engaged weight plates 50; and a means 93 to maintain proper drive operations, including spring reels 94, mirrored cams 95, resilient elements, counter weights and closed circuit means.

Open VPR circuits 90 exemplified in FIG. 11, present perhaps the most cost effective VPR circuit. The preferred open VPR circuit 90 utilizes a spring reel 94 as a means 93 to maintain proper drive operations. Furthermore, it is recommended to use only a progressive range engagement means 33, as to allow the primary take-up means 93 (i.e. spring reel 94) to always operate through the VPR equipped selectorized weight stack 10 and maintain proper drive operations. If bi-directional VPR engagement 32 is desired in an open VPR circuit 90, a secondary take-up means must be incorporated to maintain proper drive operations.

Closed VPR circuits 91 exemplified in FIG. 12, present perhaps the most versatile VPR circuit, in that the benefits of both bi-directional engagement 32 and progressive range engagement 33 can be interchangeablly utilized without incorporating a secondary take-up means. The preferred take-up means 93 includes a mirrored cam arrangement 95 to maintain proper drive operations. Furthermore, a bi-directionally engaged 32 closed VPR circuit 91 allows ROM element movement only in the area of weight stack travel 42, and provides a useful ROM element position stop when a FC engaged weight plate 50 comes to rest on the remaining unengaged stack or stack supporting frame 15; a user friendly feature that can maintain a selected starting ROM between exercising sets, or perhaps restrict a medical rehabilitation patient to a prescribed range of motion.

The VPR system 10 can be readily incorporated into any strength system and provide superior operation and reliability. Typically, a user can easily enter a VPR 10 equipped strength system by moving free wheeling ROM elements to a comfortable entry position and then select a desired resistance level at a selected range of motion and begin exercising, or if so desired, automatically progress into greater ranges of motion at the same selected resistance level by simply moving respective ROM elements into a greater ROM. In addition, if a ROM start and stop selection and or a ROM index reference is desired, it can be incorporated about a ROM element's axis of rotation or as in many cases integrated into respective cams. These options could be adapted to act either passively (as a reference) or as an active stop to prevent an undesired ROM.

By guiding excess FC 22 to existing machine areas, the VPR system 10 can provide a range greater than a given weight stack travel 42 in which that weight stack travel 42 can be utilized, without adding machine size or total weight stack complex height 43. This feature will facilitate a new generation of multiple functioning strength systems, by providing a source of pay-out and take-up of excess FC 22, and therefore simplify the set-up (i.e. threading of FC in-line drive elements 96) of a selected exercise. Furthermore, unlike prior range-limiting devices, cams incorporated by VPR 10 equipped strength systems can rigidly operate in-line to ROM elements and therefore provide a biomechanical correct variable resistance throughout any selected range of motion. Lastly, VPR systems 10 can provide infinite ROM increments by incorporating a FC 21 such as a kevlar webbing that facilitates infinite points of engagement along its length with a suitable engagement means (i.e. frictional camming devices, etc.). Although a VPR system of this type could be implemented, its cost and foreseeable unreliability could prevent it from entering the market place. These and other advantages will evolve with the integration of VPR equipped selectorized weight stacks 10.

Figure 13:
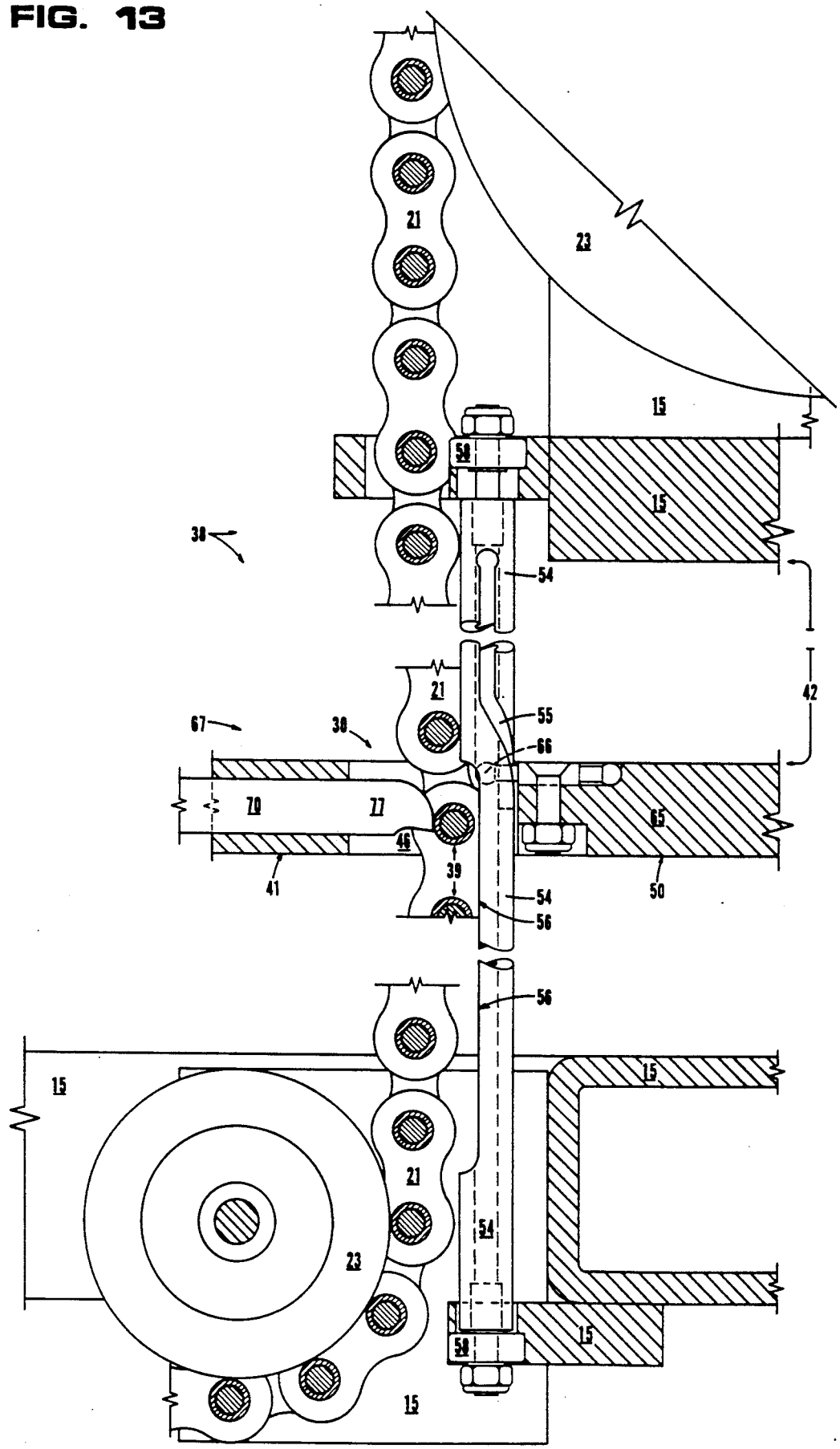
FIG. 13 is a vertical sectional view exemplifying a preferred means of eliminating FC disengagement during weight stack travel while a top engaged weight plate is in a resting position (prior to weight stack travel) and an avenue of FC disengagement is open.
Figure 14:
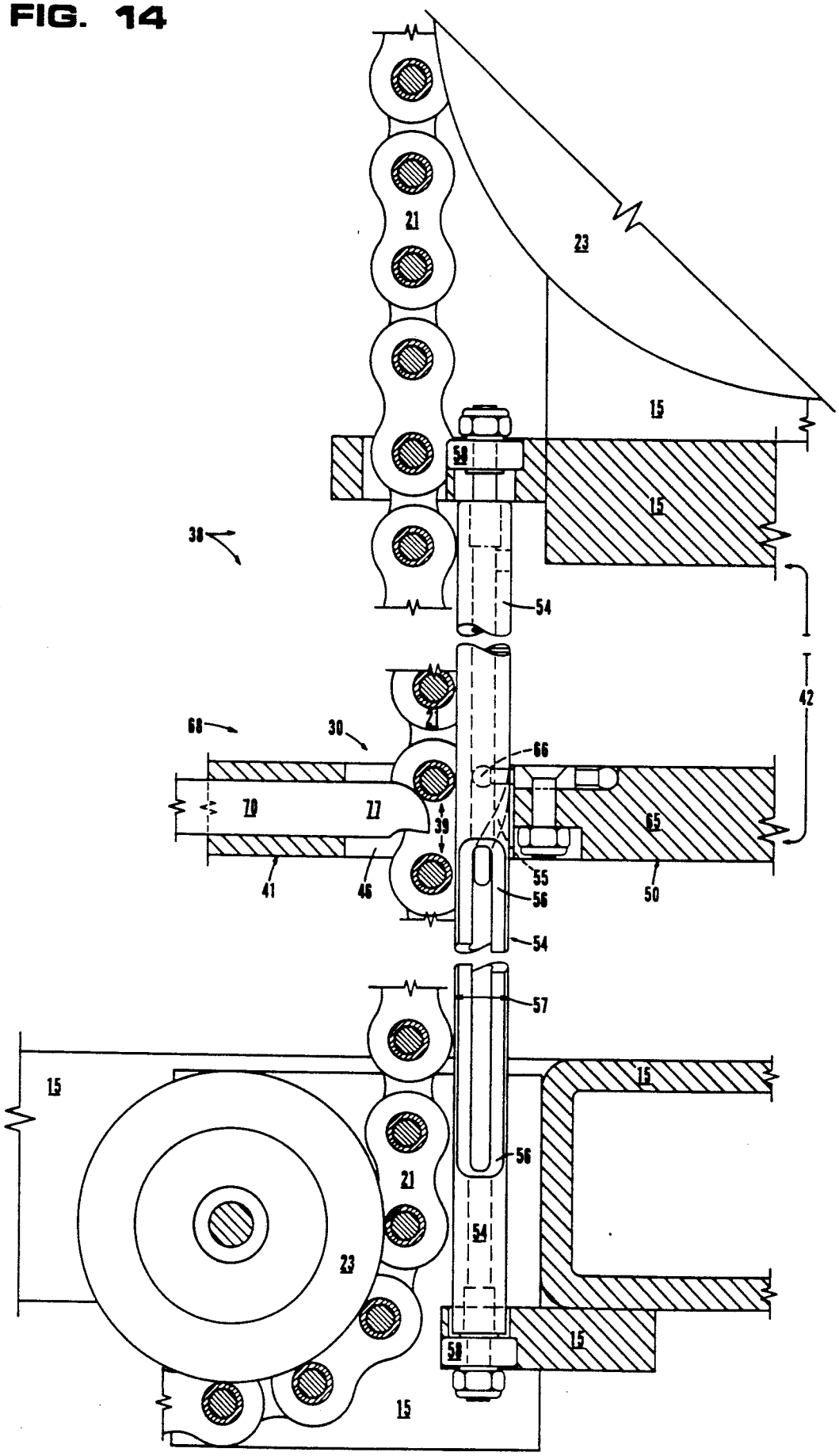
FIG. 14 is a vertical sectional view exemplifying a preferred means of eliminating FC disengagement during weight stack travel while a top engaged weight plate is in weight stack travel and an avenue of FC disengagement is closed.
Figure 15:
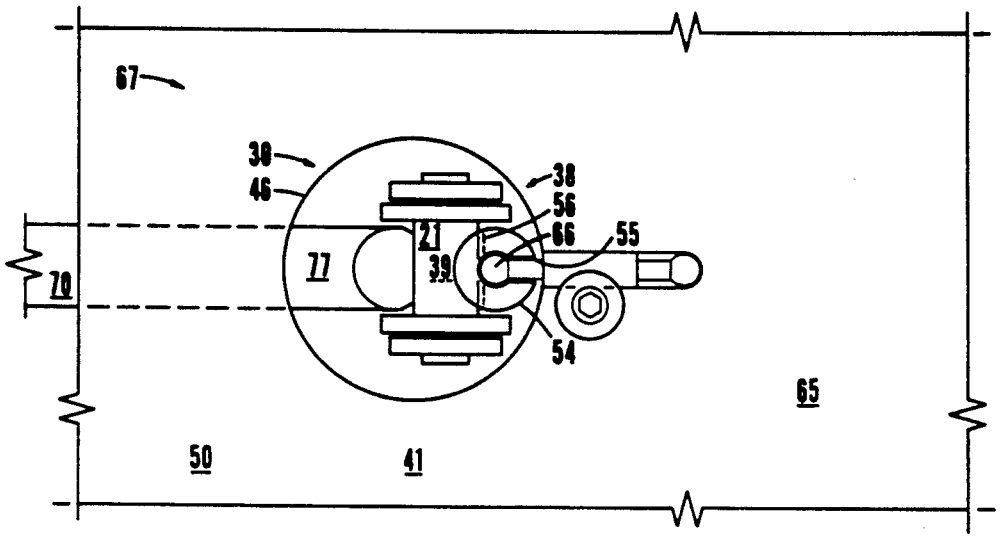
FIG. 15 is a top view of FIG. 13's top engaged weight plate exemplifying a preferred means of eliminating FC disengagement during weight stack travel while the top engaged weight plate is in a resting position (prior to weight stack travel) and an avenue of FC disengagement is open.
Figure 16:
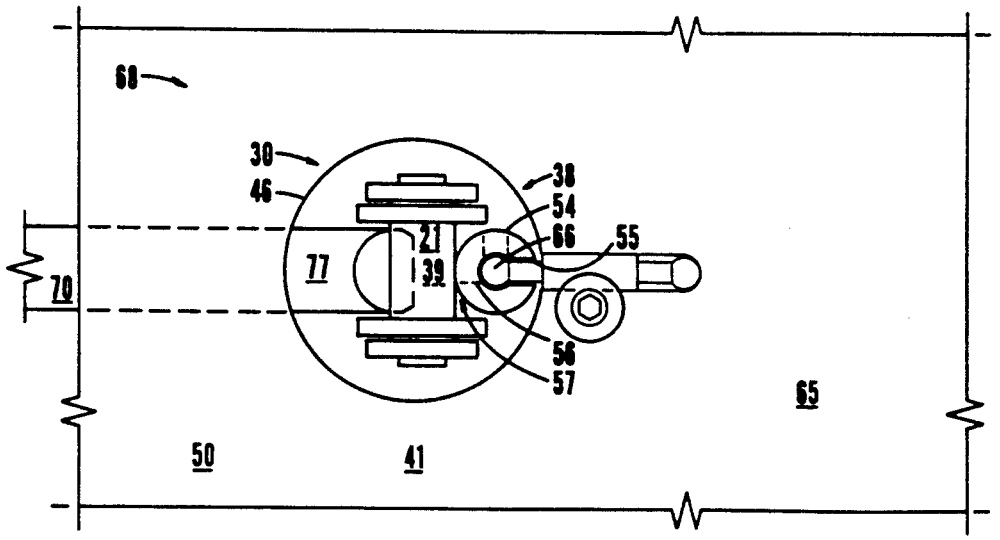
FIG. 16 is a top view of FIG. 14's top engaged weight plate exemplifying a preferred means of eliminating FC disengagement during weight stack travel while the top engaged weight plate is in weight stack travel and an avenue of FC disengagement is closed.

The preferred means 38 of eliminating FC disengagement during weight stack travel 42 is exemplified in FIGS. 13–16 and comprises of a rotating rod 54 adapted to open an avenue of FC disengagement 39 (i.e. FC's line of guide offset 63) when a weight stack's 40 top weight plate 65 is in a resting position 67 (i.e. prior to weight stack travel; FIGS. 13 and 15) and further adapted to close the avenue of FC disengagement 39 when the top weight plate 65 is lifted in a weight stack travel position 68 (FIGS. 14 and 16). The rod 54 extends the combined length of a weight stack 40 and its respective weight stack travel 42, and is mounted in the FC's avenue of disengagement 39 from above and below this region by rotational mounting means 58 that allow rotation to occur thru the rod's 54 length. Along the rod's 54 length there is a recessed region 56 extending the length of a respective weight stack 40 that provides an open avenue of FC disengagement 39 only when the top weight plate 65 is in its resting position 67 (exemplified by FIGS. 13 and 16). Since the top weight plate 65 is lifted with every resistance selection, a rotator pin 66 is integrated within it and adapted to be received by a helical groove 55 integrated along the rod's 54 length as to rotate the rod 54 ninety degrees when the top weight plate 65 is lo lifted in weight stack travel 42. The helical groove 55 and rotator pin 66 is appropriately designed as to provide a proper blend of smooth operation combined with a ninety degree rod 54 rotation in the shortest possible weight stack travel 42. Initially when the top weight plate 65 is in its resting position 67 the rod's 54 recessed region 56 provides an open avenue of FC disengagement 39 (exemplified in FIGS. 13 and 15) facilitating progressive range engagement 33 and bi-directional engagement 32 exhibiting automatic FC engagement 60. When the top weight plate 65 is lifted in weight stack travel, 42 the rotator pin 66 rotates the rod 54 ninety degrees via the helical groove 55, so that the rod's 54 full profile 57 closes the avenue of FC disengagement 39 (exemplified in FIGS. 14 and 16). As the top weight plate 65 returns to its resting position 67 the rotator pin 66 rotates the rod 54 back ninety degrees so that the rod's 54 recessed region 56 reopens the avenue of FC disengagement 39 (exemplified in FIGS. 13 and 15). Furthermore, the above preferred means 38, eliminates FC disengagement during weight stack travel 42 only at the selected engaged weight plate 50, whereby only having to abate the residual inertia of a single selected engaged weight plate 50.

In compliance with the stature, the invention has been described in language more or less specific as to structural features. It is to be understood, however, that the invention is not limited to the specific features shown, since the means and the construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A resistance engagement system for exercising apparatuses comprising:

a frame means supporting components of said resistance engagement system;

a vertically stacked array of individual engageable weight plates;

a weight stack travel above said vertically stacked array of individual engageable weight plates for vertical oscillatory movement of selected said weight plates;

a guide means for guiding selected said weight plates for vertical oscillatory movement in said weight stack travel;

a flexible connector;

a flexible connector guide means for guiding said flexible connector from above said weight stack travel and below said vertically stacked array of individual engageable weight plates for a line of guide of vertical oscillatory movement about said vertically stacked array of individual engageable weight plates; and an engaging means for selectively engaging said flexible connector at a selected point along its length to a selected said individual engageable weight plate.

2. A resistance engagement system for exercising apparatuses according to claim 1 wherein each said weight plate includes said engaging means for selectively engaging said flexible connector at a selected point along its length.

3. A resistance engagement system for exercising apparatuses according to claim 1 wherein said engaging means including:

a bi-directional engagement means to bi-directionally engage said flexible connector at a selected point along its length to a selected said weight plate;

progressive range engagement means to engage said flexible connector solely when said flexible connector is drawn in said weight stack travel at a selected point along its length to a selected said weight plate; and an automatic flexible connector engagement means to automatically engage said flexible connector at a misaligned selected point along its length to a selected said weight plate.

4. A resistance engagement system for exercising apparatuses according to claim 3 wherein said resistance engagement system includes a means to allow flexible connector disengagement with a selected engaged weight plate prior to said weight stack travel as to facilitate said progressive range engagement, said bi-directional engagement and said automatic flexible connector engagement; and a means to eliminate flexible connector disengagement with a selected engaged weight plate during said weight stack travel.

5. A resistance engagement system for exercising apparatuses according to claim 3 wherein said flexible connector extends through a vertical opening extending through the central portion of said vertically stacked array of individual engageable weight plates and is guided by said flexible connector guide means for said line of guide of vertical oscillatory movement therethrough.

6. A resistance engagement system for exercising apparatuses according to claim 5 wherein each said weight plate includes a horizontal way that intersects said vertical opening of said vertically stacked array of individual engageable weight plates; and, wherein said engaging means including engaging element means for extending into a selected said horizontal way for either a selected said bi-directional engagement means or said progressive range engagement means.

7. A resistance engagement system for exercising apparatuses according to claim 6 wherein said flexible connector including points of engagement along its length for engaging said engaging element means.

8. A resistance engagement system for exercising apparatuses according to claim 7 wherein said engaging element means comprising a pair of interchangeable weight support pins including a bi-directional engagement pin and a progressive range engagement pin; said bi-directional engagement pin including:

a shank for engaging a selected said horizontal way;

a bi-directional engagement tip supported by said shank for extending into said flexible connectors line of guide for engaging a selected said point of engagement for said bi-directional engagement means; and said automatic engagement means including a means to engage a misaligned selected said point of engagement with said bi-directional engagement tip, said automatic engagement means is achieved by means of said misalignment creates an offset in said flexible connector's line of guide, whereupon said selected point of engagement is moved about said bi-directional engagement tip in said vertical oscillatory movement, and a proper alignment is achieved allowing said selected point of engagement to return to its said line of guide and engage said bi-directional engagement tip; and, wherein said progressive range engagement pin including:

a shank for engaging a selected said horizontal way;

a progressive range engagement tip supported by said shank for extending into said flexible connector's line of guide for engaging a selected said point of engagement for said progressive range engagement means; and said automatic engagement means including a means to engage a misaligned selected said point of engagement with said progressive range engagement tip, said automatic engagement means is achieved by means of said misalignment creates an offset in said flexible connector's line of guide, whereupon said selected point of engagement is moved about said progressive range engagement tip in said vertical oscillatory movement, and a proper alignment is achieved allowing said selected point of engagement to return to its said line of guide and engage said progressive range engagement tip.

9. A resistance engagement system for exercising apparatuses according to claim 7 wherein each said point of engagement along said flexible connector's length including a lower stop and an upper stop for engaging said bi-directional engagement tip and said progressive range engagement tip in respective upward and downward said vertical oscillatory movement, said bi-directional engagement tip including a lower engaging surface to engage a selected said lower stop during said upward flexible connector movement and a upper engaging surface to engage a selected said upper stop during said downward flexible connector movement for said bi-directional engagement means; and, wherein said progressive range engagement tip including a lower engaging surface to engage a selected said lower stop during said upward flexible connector movement and a passive upper surface for allowing selected said upper stops to pass by without being engaged during respective said downward flexible connector movement, for said progressive range engagement means.

10. A resistance engagement system for exercising apparatuses comprising:

a frame means supporting components of said resistance engagement system;

a carriage means for receiving selected weight plates or a weight pack;

a carriage travel above said carriage means for upright oscillatory movement of said carriage means;

a guide means for guiding said carriage means for said upright oscillatory movement in said carriage travel;

a flexible connector;

a flexible connector guide means for guiding said flexible connector from above said carriage travel and below said carriage means for said upright oscillatory movement about said carriage means; and an engaging means for selectively engaging said flexible connector at a selected point along its length to said carriage means.

11. A resistance engagement system for exercising apparatuses according to claim 10 wherein said engaging means including:

a bi-directional engagement means to bi-directionally engage said flexible connector at a selected point along its length to said carriage means;

a progressive range engagement means to engage said flexible connector solely when said flexible connector is drawn in said carriage travel at a selected point along its length to said carriage mean,5; and an automatic flexible connector engagement means to automatically engage said flexible connector at a misaligned selected point along its length to said carriage means.

12. A resistance engagement system for exercising apparatuses according to claim 11 wherein said resistance engagement system includes a means to allow flexible connector disengagement with said carriage means prior to said carriage travel as to facilitate said progressive range engagement, said bi-directional engagement and said automatic flexible connector engagement; and a means to eliminate flexible connector disengagement with said carriage means during said carriage travel.

13. A physical exercising apparatus comprising:

a frame means supporting components of said physical exercising apparatus;

a vertically stacked array of individual engageable weight plates;

a weight stack travel above said vertically stacked array of individual engageable weight plates for vertical oscillatory movement of selected said weight plates;

a guide means for guiding selected said weight plates for vertical oscillatory movement in said weight stack travel;

a flexible connector;

a flexible connector guide means for guiding said flexible connector from above said weight stack travel and below said vertically stacked array of individual engageable weight plates for a line of guide of vertical oscillatory movement about said vertically stacked array of individual engageable weight plates;

an engaging means for selectively engaging said flexible connector at a selected point along its length to a selected said individual engageable weight plate; and a flexible connector in-line element means operating in-line to said flexible connector for engaging a user and transmitting a lifting force imparted by said user to said flexible connector.

14. A physical exercising apparatus according to claim 13 wherein each said weight plate includes said engaging means for selectively engaging said flexible connector at a selected point along its length.

15. A physical exercising apparatus according to claim 13 in said engaging means including:

a bi-directional engagement means to bi-directionally engage said flexible connector at a selected point along its length to a selected said weight plate;

a progressive range engagement means to engage said flexible connector solely when said flexible connector is drawn in said weight stack travel at a selected point along its length to a selected said weight plate; and an automatic flexible connector engagement means to automatically engage said flexible connector at a misaligned selected point along its length to a selected said weight plate.

16. A physical exercising apparatus according to claim 15 in said physical exercising apparatus includes a means to allow flexible connector disengagement with a selected engaged weight plate prior to said weight stack travel as to facilitate said progressive range engagement, said bi-directional engagement and said automatic flexible connector engagement; and a means to eliminate flexible connector disengagement with a selected engaged weight plate during said weight stack travel.

17. A physical exercising apparatus according to claim 15 wherein said flexible connector extends through a vertical opening extending through the central portion of said vertically stacked array of individual engageable weight plates and is by said flexible connector guide means for said line of guide of vertical oscillatory movement therethrough.

18. A physical exercising apparatus according to claim 17 wherein each said weight plate includes a horizontal way that intersects said vertical opening of said vertically stacked array of individual engageable weight plates; and, wherein said engaging means including engaging element means for extending into a selected said horizontal way for either a selected said bi-directional engagement means or said progressive range engagement means.

19. A physical exercising apparatus according to claim 18 wherein said flexible connector including points of engagement along its length for engaging said engaging element means.

20. A physical exercising apparatus according to claim 18 wherein said engaging element means comprising a pair of interchangeable weight support pins including a bi-directional engagement pin and a progressive range engagement pin; said bi-directional engagement pin including:

a shank for engaging a selected said horizontal way;

a bi-directional engagement tip supported by said shank for extending into said flexible connector's line of guide for engaging a selected said point of engagement for said bi-directional engagement means; and said automatic engagement means including a means to engage a misaligned selected said point of engagement with said bi-directional engagement tip, said automatic engagement means is achieved by means of said misalignment creates an offset in said flexible connector's line of guide, whereupon said selected point of engagement is moved about said bi-directional engagement tip in said vertical oscillatory movement, and a proper alignment is achieved allowing said selected point of engagement to return to its said line of guide and engage said bi-directional engagement tip; and, wherein said progressive range engagement pin including:

a shank for engaging a selected said horizontal way;

a progressive range engagement tip supported by said shank for extending into said flexible connector's line of guide for engaging a selected said point of engagement for said progressive range engagement means; and said automatic engagement means including a means to engage a misaligned selected said point of engagement with said progressive range engagement tip, said automatic engagement means is achieved by means of said misalignment creates an offset in said flexible connector's line of guide, whereupon said selected point of engagement is moved about said progressive range engagement tip in said vertical oscillatory movement, and a proper alignment is achieved allowing said selected point of engagement to return to its said line of guide and engage said progressive range engagement tip.

21. A physical exercising apparatus according to claim 20 wherein each said point of engagement along said flexible connector's length including a lower stop and an upper stop for engaging said bi-directional engagement tip and said progressive range engagement tip in respective upward and downward said vertical oscillatory movement; said bi-directional engagement tip including a lower engaging surface to engage a selected said lower stop during said upward flexible connector movement and a upper engaging surface to engage a selected said upper stop during said downward flexible connector movement for said bi-directional engagement means; and, wherein said progressive range engagement tip including a lower engaging surface to engage a selected said lower stop during said upward flexible connector movement and a passive upper surface for allowing selected said upper stops to pass by without being engaged during respective said downward flexible connector movement, for said progressive range engagement means.

22. A physical exercising apparatus comprising:

a frame means supporting components of said physical exercising apparatus;

a carriage means for receiving selected weight plates or a weight pack;

a carriage travel above said carriage means for upright oscillatory movement of said carriage means;

a guide means for guiding said carriage means for said upright oscillatory movement in said carriage travel;

a flexible connector;

a flexible connector means for guiding said flexible connector from above said carriage travel and below said carriage means for said upright oscillatory movement about said carriage means;

an engaging means for selectively engaging said flexible connector at a selected point along its length to said carriage means; and a flexible connector in-line element means operating in-line to said flexible connector for engaging a user and transmitting a lifting force imparted by said user to said flexible connector.

23. A physical exercising apparatus according to claim 22 wherein said engaging means including:

a bi-directional engagement means to bi-directionally engage said flexible connector at a selected point along its length to said carriage means;

a progressive range engagement means to engage said flexible connector solely when said flexible connector is drawn in said carriage travel at a selected point along its length to said carriage means; and an automatic flexible connector engagement means to automatically engage said flexible connector at a misaligned selected point along its length to said carriage means.

24. A physical exercising apparatus according to claim 23 wherein said physical exercising apparatus includes a means to allow flexible connector disengagement with said carriage means prior to said carriage travel as to facilitate said progressive range engagement, said bi-directional engagement and said automatic flexible connector engagement; and a means to eliminate flexible connector disengagement with said carriage means during said carriage travel.

* * * * *